US007143991B2

(12) United States Patent
Hirokawa et al.

(10) Patent No.: US 7,143,991 B2
(45) Date of Patent: Dec. 5, 2006

(54) REINFORCING BAR JOINT SLEEVE FIXING DEVICE

(75) Inventors: Toru Hirokawa, Sanjyo (JP); Ichiro Kano, Sakura (JP)

(73) Assignee: Splice Sleeve Japan, Ltd., Tokyo (JP)

( * ) Notice: Subject to any disclaimer, the term of this patent is extended or adjusted under 35 U.S.C. 154(b) by 400 days.

(21) Appl. No.: 10/864,486

(22) Filed: Jun. 10, 2004

(65) Prior Publication Data

US 2004/0250502 A1 Dec. 16, 2004

(30) Foreign Application Priority Data

Jun. 12, 2003 (JP) ..... 2003-167387

(51) Int. Cl.
*B28B 7/00* (2006.01)
*B28B 23/00* (2006.01)

(52) U.S. Cl. ..... 249/205; 249/97; 249/205; 425/111; 264/228; 264/229; 52/223.13

(58) Field of Classification Search ..... 52/223.13; 264/228, 229; 425/111; 249/97, 205, 219.1
See application file for complete search history.

(56) References Cited

U.S. PATENT DOCUMENTS

| | | | | |
|---|---|---|---|---|
| 2,607,370 A | * | 8/1952 | Anderson | 138/90 |
| 4,159,099 A | * | 6/1979 | Maguire | 249/93 |
| 4,749,170 A | * | 6/1988 | Ase | 264/256 |
| 5,468,524 A | * | 11/1995 | Albrigo et al. | 428/34.1 |

FOREIGN PATENT DOCUMENTS

| | | | |
|---|---|---|---|
| JP | 7-34109 | | 2/1995 |
| JP | 7-279316 | * | 10/1995 |
| JP | 8-218555 | * | 8/1996 |
| JP | 2005-1257 | * | 1/2005 |

* cited by examiner

*Primary Examiner*—Robert Canfield
(74) *Attorney, Agent, or Firm*—Westerman, Hattori, Daniels & Adrian, LLP.

(57) ABSTRACT

A reinforcing bar joint sleeve fixing device for fixing a reinforcing bar joint sleeve disposed in the interior of precast concrete to a molding form in fabricating a precast concrete structure with use of the molding form, which device permits both axial and radial positions of the reinforcing bar joint sleeve to be set positively and is employable repeatedly, the reinforcing bar joint sleeve fixing device comprises a cylindrical ring member disposed in the interior of a reinforcing bar joint sleeve, a plurality of slide pins fitted in an outer wall of the ring member so as to be slidable radially outwards, an elastic ring for pressing the plural slide pins radially inwards, a shaft formed of a head portion and a rod portion concentric with the head portion, the head portion being received in the interior of the ring member and having a conical shape which is larger in diameter toward axially the inside of the reinforcing bar joint sleeve, an insertion hole formed in the molding form for insertion therethrough of the rod portion of the shaft, a fixing member adapted to come into threaded engagement with a screw portion formed in the rod portion of the shaft, and slide portions formed at radial ends of the slide pins so as to be movable radially outwards in conformity with a tapered surface of the conical head portion of the shaft.

4 Claims, 7 Drawing Sheets

REINFORCING BAR JOINT SLEEVE FIXING DEVICE

TECHNICAL FIELD OF THE INVENTION

The present invention relates to a reinforcing bar joint sleeve fixing device for fixing a reinforcing bar joint sleeve disposed in the interior of precast concrete by fabricating a precast concrete structure (hereinafter referred to simply as "PC structure") utilizing a molding form.

FIG. 8 illustrates a PC structure fabricating method using a conventional reinforcing bar joint sleeve fixing device. More particularly, FIG. 8 shows a state in which a reinforcing bar 29 and a reinforcing bar joint sleeve 1 are secured to a molding form 20 disposed on a board B with concrete placed thereon, and FIG. 9 illustrates a PC structure A obtained after removal of the molding form. In FIG. 9, a rightwards projecting portion 29*a* of the reinforcing bar 29 is for insertion into another PC structure, and the reinforcing bar joint sleeve 1 is for fitting with another PC structure. FIGS. 10 and 11 illustrate an example of a conventional reinforcing bar joint sleeve fixing device. See, for example, Japanese Published Examined Utility Model Publication No. Hei 7-34109 (see FIG. 1 and explanation thereof). In FIG. 10, there is disclosed a support member 26 formed of an elastic material and with a cylindrical portion 24 thereof inserted into an opening of the reinforcing bar joint sleeve 1 whose opening faces outwards of the molding form 20. A rod member 25 having an anti-dislodgment portion 18 extends through both the support member 26 and molding form 20. A cam 30 for pulling the rod member 25 outwards of the molding form 20 is pivotally connected with pin 25*a* to the rod member 25 at a position outside the molding form 20.

FIG. 11 shows a state in which the reinforcing bar joint sleeve 1 was pulled outwards of the molding form 20 by rotating the cam 30. The support member 26 is compressed as the rod member 25 moves leftwards in the figure. Particularly, as a result of the compression, the cylindrical portion 24 expands radially outwards and comes into contact with a projecting/recessed portion formed on an inner surface of the reinforcing bar joint sleeve 1 to fix the position of the sleeve 1. Thus, by positioning the cam 30 so that the rod pin 25*a* pulls the rod member 25 away from the reinforcing bar 29 the reinforcing bar joint sleeve 1 is moved outwards of the molding form 20 and is fixed to a predetermined position.

According to this construction, rough axial and radial positions of the reinforcing bar joint sleeve 1 are determined, but since the support member 26 is formed of rubber as an elastic material, the engaging of the cam 30 and the amount of axial movement of the reinforcing bar joint sleeve 1 do not coincide with each other, nor is a radial expansion quantity established.

Thus, the above construction is not suitable for strict determination of both axial and radial positions. Moreover, the cylindrical portion 24 of the support member 26 cannot withstand repeated use because of the large compressive strain from repeated radial expansion and contraction.

SUMMARY OF THE INVENTION

The present invention has been proposed in view of the above-mentioned problems of the related art. The object of the invention is to provide a reinforcing bar joint sleeve fixing device which permits both axial and radial positions of a reinforcing bar joint sleeve to be established accurately and which is employable repeatedly without excessive determination.

According to the present invention there is provided a reinforcing bar joint sleeve fixing device for fixing a reinforcing bar joint sleeve (1) disposed in the interior of precast concrete to a molding frame (20) in fabricating a precast concrete structure utilizing a molding form, the reinforcing bar joint sleeve fixing device comprising a cylindrical ring member (2) disposed in the interior of the reinforcing bar joint sleeve (20), a plurality of slide pins (3) fitted in an outer wall (2*a*) of the ring member (2) so as to be slidable radially outwards, an elastic ring (4) for pressing the plural slide pins (3) radially inwards, a shaft (A8) formed by an integral combination of a head portion (8) and a rod portion (7) concentric with the head portion (8), the head portion (8) being received in the interior of the ring member (2) and having a conical shape which is larger in diameter toward axially the inside of the reinforcing bar joint sleeve (1), an insertion hole (20*a*) formed in the molding form (20) for insertion therethrough of the rod portion (7) of the shaft, a fixing member (6) adapted to come into threaded engagement with a screw portion formed in the rod portion (7) of the shaft to fix the reinforcing bar joint sleeve (1), and slide portions (3*a*) formed at radial ends of the slide pins (3) so as to be movable radially outwards in conformity with a tapered surface of the conical head portion (8) of the shaft. It is preferable that the slide portions (3*a*) formed at the radial ends of the slide pins (3) be tapered surfaces conforming to the tapered surface of the head portion of the shaft.

Preferably the conical head portion (8) of the shaft has a taper angle of 15 to 45 degrees.

In a concrete example, it is more preferable to set the taper angle of the head portion at 35 to 40 degrees.

DETAILED DESCRIPTION OF THE INVENTION

An embodiment of the present invention will be described below with reference to the accompanying drawings.

The whole and detailed constructions of the present invention are illustrated in FIGS. 1 to 7.

Figure 1:
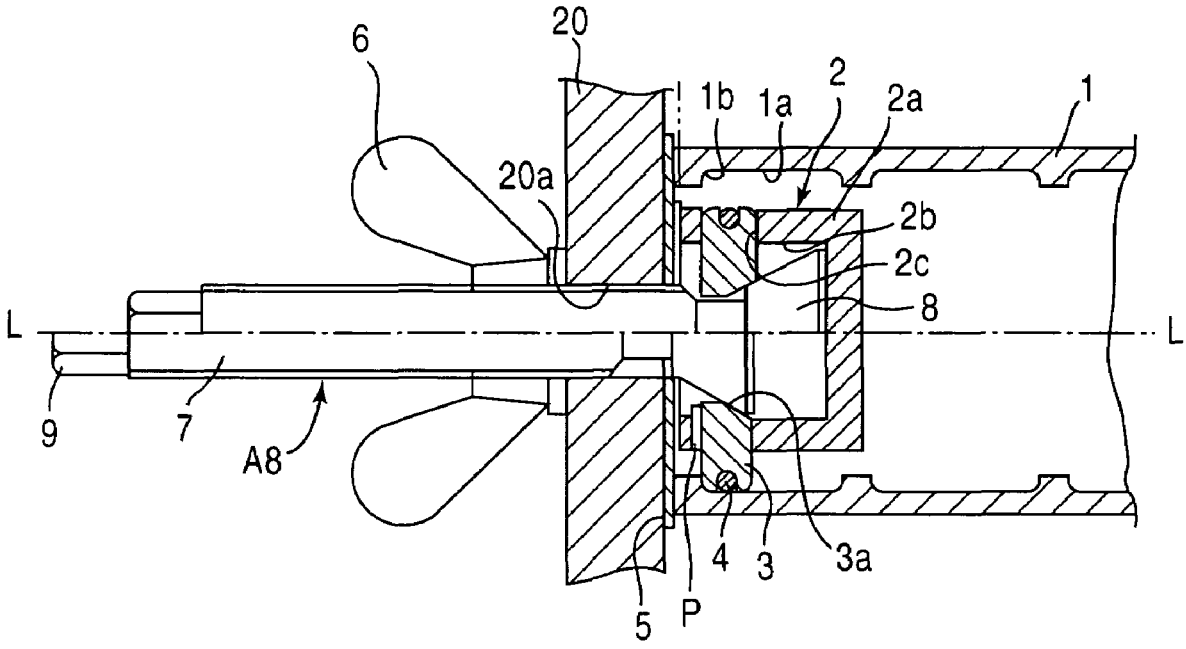
FIG. 1 is a sectional side view of a reinforcing bar joint sleeve fixing device according to the present invention, in which the upper half represents a state before fixing and the lower half represents a state after fixing.
Figure 2:
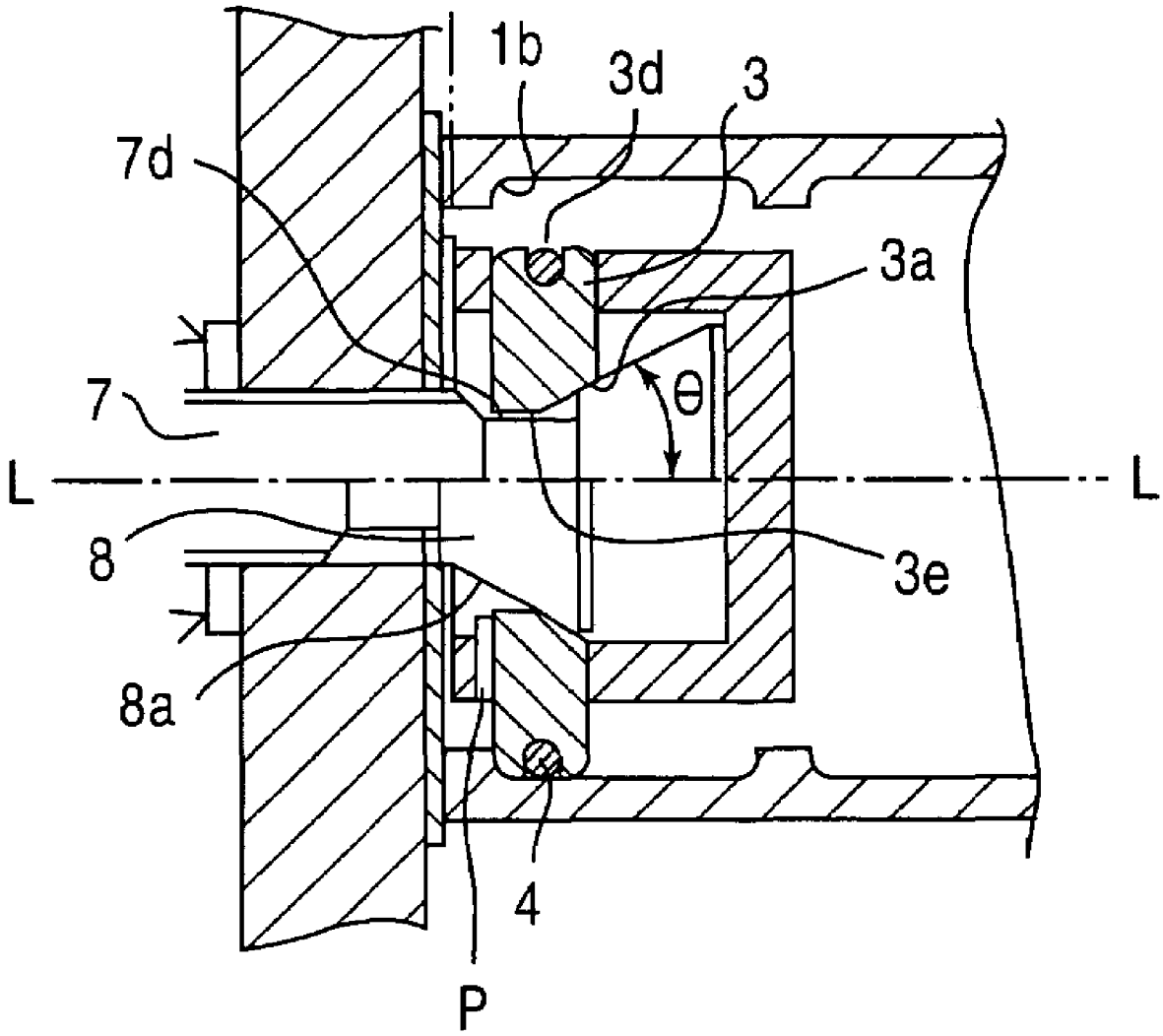
FIG. 2 illustrates a limited portion of FIG. 1, in which, like FIG. 1, the upper half represents a state before fixing and the lower half represents a state after fixing.

In FIGS. 1 and 2, a state before clamping and fixing of a reinforcing bar joint sleeve and a state after clamping and fixing of the reinforcing bar joint sleeve are shown in an upper portion and a lower portion, respectively, with respect to a center line L in the middle of the figure. A known reinforcing bar joint sleeve 1 is disposed near a molding form 20 which is for fabricating a PC structure such as PC plate, and a cylindrical ring member 2 is disposed inside the reinforcing bar joint sleeve 1 through a packing 5.

A conical head portion 8, which increases in diameter axially inwards (rightwards in the figure), is received within an inner hole 2*b* of the ring member 2.

A rod portion 7 having a screw portion is integral and concentric with an end of the conical head portion 8 to constitute a shaft A8.

The rod portion 7 extends through an insertion hole 20*a* which is formed in the molding form 20 concentrically with the reinforcing bar joint sleeve 1, and a butterfly nut 6 as a fixing member is threadedly engaged with a screw portion of the rod portion 7 and is capable of exerting force on an outer side of the molding form 20. The fixing member is not limited to a butterfly nut 6, but may be an ordinary type of nut or similar. An angular portion 9 for swivel stop is formed at an end of the rod portion 7.

As illustrated in FIG. 2, a tapered surface 8*a* of the head portion 8 has a taper angle θ of preferably 15° to 45°, more preferably 35° to 40°. The tapered surface 8*a* may be a surface which forms a cone or may be a plane formed on a conical surface.

Plural slide pins 3 whose end portions conform to the tapered surface 8*a* are fitted in a cylindrical side face of the ring member 2 so as to be movable radially inwards and outwards. Retaining pins P are provided on the molding form 20 side (on the left side in the figure) of the slide pins 3 to lock the tapered surface 8*a* and hence prevent dislodgment of the shaft A8 which will be described later. However, the pins P are not always needed.

Figure 3:
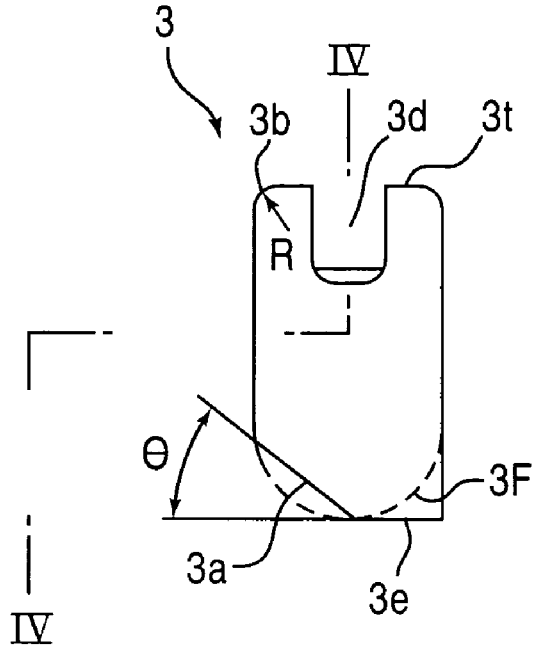
FIG. 3 is a side view of a slide pin.
Figure 4:
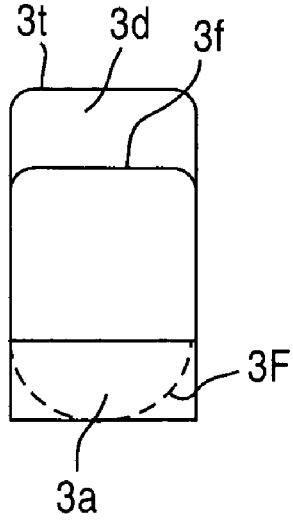
FIG. 4 is a sectional view taken on line I—I of FIG. 3.

FIGS. 3 and 4 illustrate each slide pin 3, in which a tapered surface 3*a* conforming to the tapered surface 8*a* of the head portion 8 of the shaft A8 is formed at a lower end 3*e* of the slide pin, and a groove 3*d* is formed in an upper end 3*t* of the slide pin.

An elastic ring 4 to be described later comes into close contact with a bottom of the groove 3*d*. Preferably the radius of a corner-3*b* of the upper end 3*t* is equal to the radius of a round recessed portion 1*b* formed in an inner surface of the reinforcing bar joint sleeve 1.

The tapered surface 3*a* acts as a slide portion for each slide pin 3 (which conforms to the tapered surface 8*a* of the head portion 8 of the shaft A8) and may be a spherical surface 3F as indicated with a dotted line in FIGS. 3 and 4 or may be any other surface which is slidable in conformity with the tapered surface.

Figure 5:
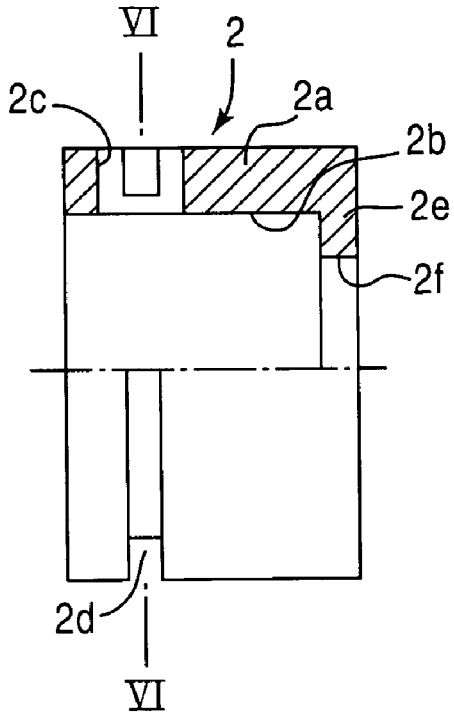
FIG. 5 is a side view of a ring member.
Figure 6:
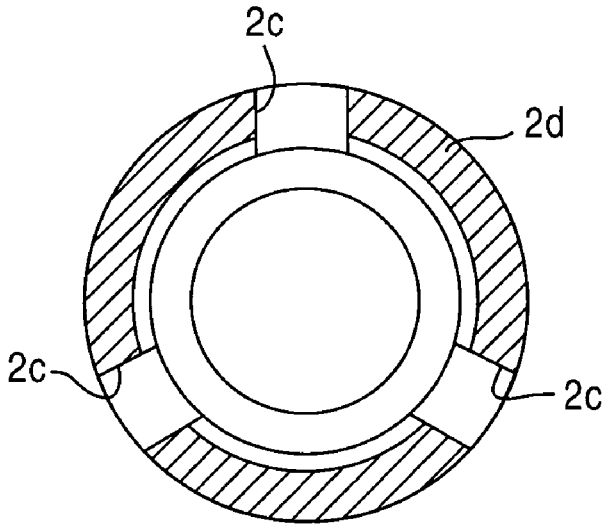
FIG. 6 is a sectional view taken on line II—II of FIG. 5.
Figure 7:
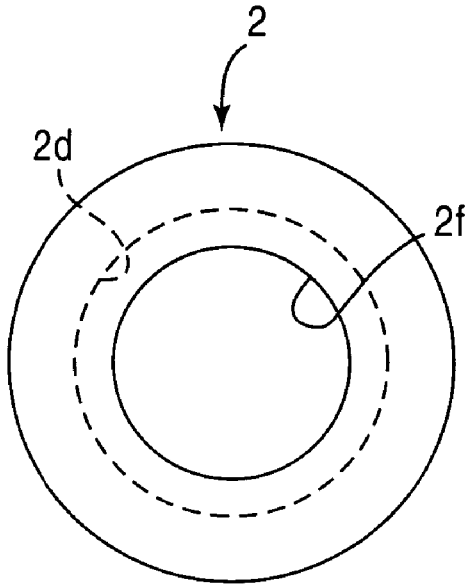
FIG. 7 is a rear view of FIG. 5.
Figure 8:
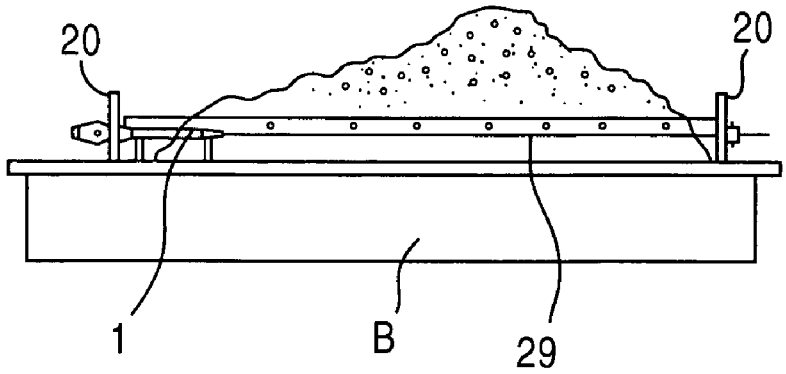
Fig.8 Related Art
FIG. 8 illustrates a method for fabricating a PC structure using a conventional reinforcing bar joint sleeve fixing device.
Figure 9:
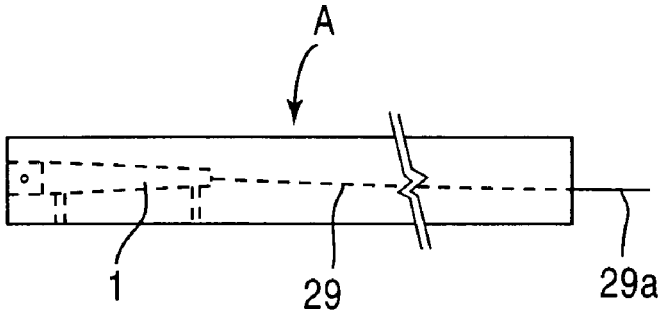
Fig.9 Related Art
FIG. 9 illustrates a PC structure obtained after removal of a molding form.
Figure 10:
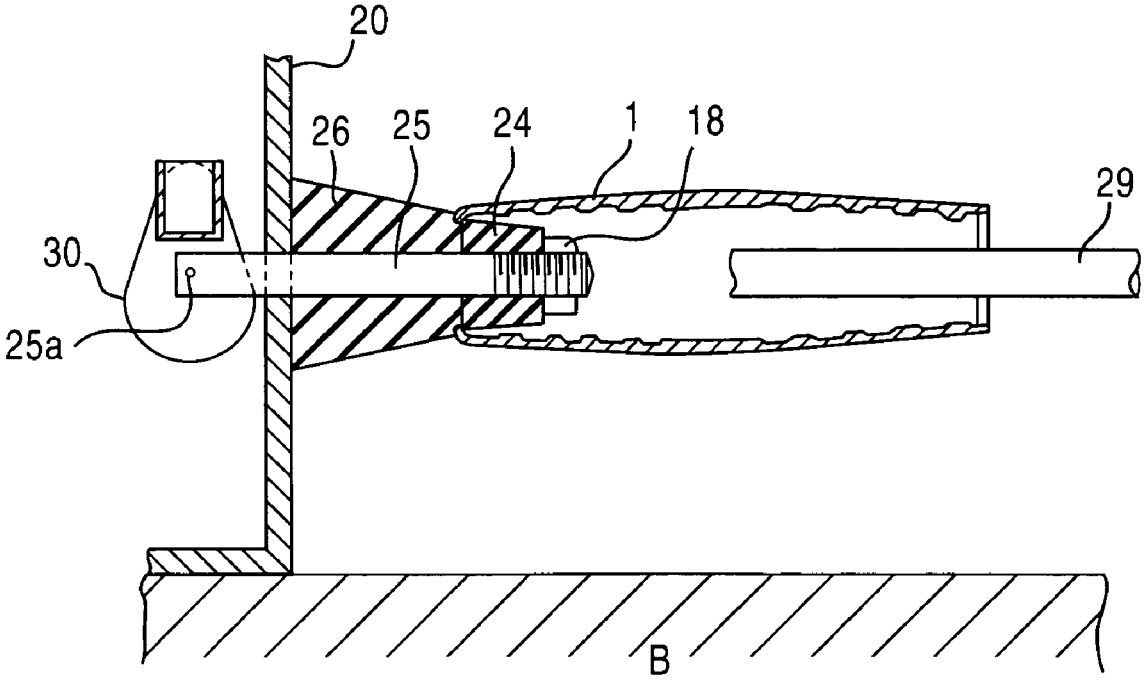
Fig.10 Related Art
FIG. 10 illustrates a state before fixing with use of the conventional reinforcing bar joint sleeve fixing device.
Figure 11:
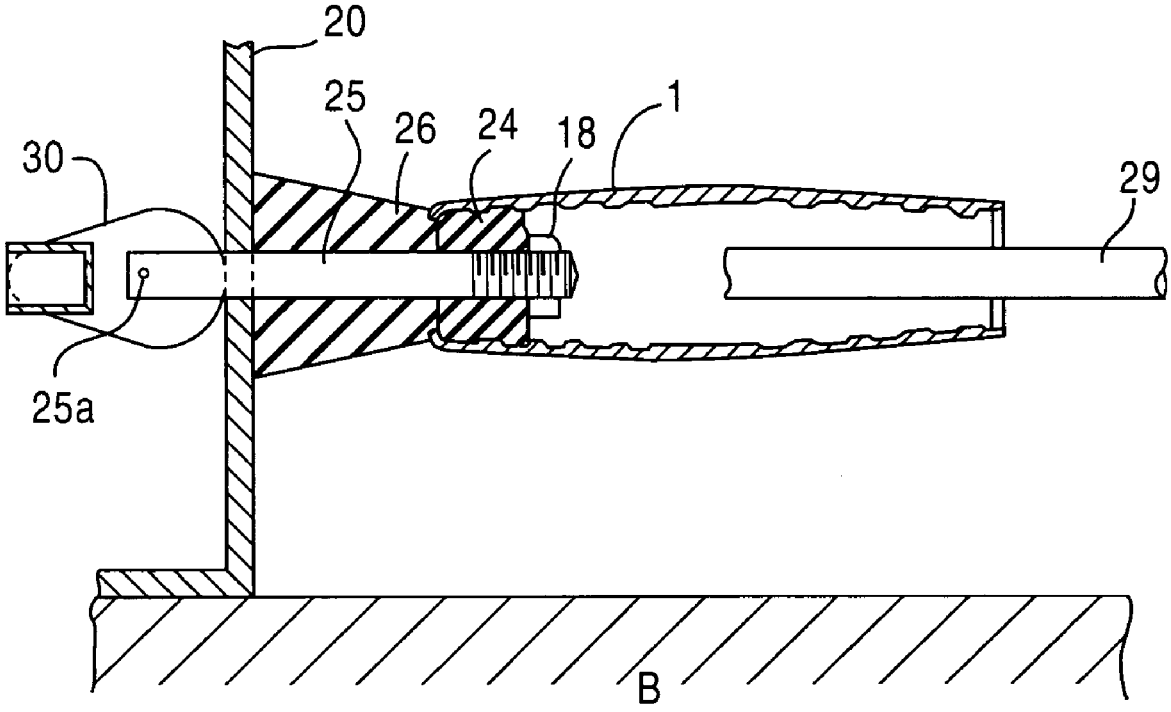
Fig.11 Related Art
FIG. 11 illustrates a state after fixing in FIG. 10.

FIGS. 5 to 7 are detail views of the ring member 2.

The ring member 2 is formed in a cylindrical shape having an inside diameter of 2*b* which is defined by both side wall surface 2*e* and outer wall 2*a*, the side wall surface 2*e* having a small hole 2*f* for preventing the passage of the conical head 8 of the shaft A8 through the ring member. However, the small hole 2*f* may be substituted by a bottom without formation thereof. In the figures, three pin holes 2*c* are formed isometrically in the outer wall 2*a*. The pin holes 2*c* are formed at a diameter which permits the slide pins 3 to slide.

A groove 2*d* is formed throughout the circumference of the ring member 2 so as to pass through the center of each pin hole 2*c* and it has a width equal to the width of the groove 3*d* of each slide pin 3.

The elastic ring 4 made of rubber is fitted in the grooves 3*d* of the slide pins 3, and with the elastic force thereof, the slide pins 3 are pressed into the ring member 2.

A description will be given below of the operation of the reinforcing bar joint sleeve constructed as above.

Referring to FIGS. 1 and 2, the head portion 8 of the shaft A8 is inserted into the inner hole 2*b* of the ring member 2 in the reinforcing bar joint sleeve 1 and the slide pins 3 are inserted into the inner hole 2*b* from radially outward positions with respect to the ring member 2. At this time, the tapered surfaces 3*a* as slide portions of the slide pins 3 are checked and conformed to the tapered surface 8*a* of the head portion 8 of the shaft A8.

Then, the elastic ring 4 is fitted in the grooves 3*d* of the slide pins 3 and is also fitted in the groove 2*d* of the ring member 2, causing the slide pins 3 to be pressed into the ring member 2.

At this stage of the ring member 2, shaft A8 and slide pins 3 having been constituted in one piece with one another, the rod portion 7 is inserted through the insertion hole 20*a* of the molding form 20 through the packing 5 and the butterfly nut 6 is brought into threaded engagement with the rod portion. The steps so far described constitute an assembling stage, which corresponds to the state of the upper portions with respect to the center lines L in FIGS. 1 and 2.

Next, a fixing position for the reinforcing bar joint sleeve 1 is described.

The butterfly nut 6 is turned, causing the shaft A8 to be pulled and moved in the direction opposite to the reinforcing bar joint sleeve 1, i.e., leftwards in the figures. At this time, the angular portion, i.e., hexagonal portion, for swivel stop is clamped to prevent co-rotation of the shaft A8 with the butterfly nut 6.

With the movement of the shaft A8, the head portion 8 and the tapered surface 8*a* also move and the slide pins 3 slide radially outwards. The amount of this radially outward movement of the slide pins 3 is determined by the number of turns of the butterfly nut 6, that is, by the amount of movement of the shaft A8.

Then, the corners 3*b* at the upper ends of the slide pins 3 in FIG. 3 come into contact with the round portion 1*b* formed on the inner surface of the reinforcing bar joint sleeve 1.

As the amount of the radially outward movement of the slide pins 3 increases, the upper ends 3*t* of the slide pins 3 come into contact with a recessed portion 1*a* formed on the inner surface of the reinforcing bar joint sleeve 1. Since the three slide pins 3 are equal in the amount of radial movement, the shaft A8 and the reinforcing bar joint sleeve are surely aligned with each other. In this stage, abutment of the slide pins 3 against the concave portion 1*a* can be clearly judged from a rotational resistance of the butterfly nut 6.

If the butterfly nut 6 is further rotated, the corner portions 3*b* of the slide pins 3 push the round portion 1*b* of the reinforcing bar joint sleeve 1 leftwards and pull and move the sleeve 1 up to a predetermined position where the sleeve is put in close contact with the molding form.

In this way, both axis accuracy and movement position of the reinforcing bar joint sleeve 1 can be strictly determined. The steps described above constitute a fixing stage, which corresponds to the state of the lower portions with respect to the center lines in FIGS. 1 and 2.

Next, for removing the fixing device from the molding form, the butterfly nut 6 is turned reverse to let the shaft A8 move toward the reinforcing bar joint sleeve 1. With the rightward movement of the shaft A8, the head portion 8 and the tapered surface 8*a* also move. Under the clamping force of the elastic ring 4, the slide pins 3 slide radially inwards along the tapered surface 8*a*.

In this way, a return is made to the assembling stage and the device, including the shaft A8, is removed, and can be re-used.

Functions and effects of the present invention are as follows.

(a) In the reinforcing bar joint sleeve fixing device according to the present invention, the ring member, shaft and slide pins are solid members free of elasticity, so that both axis position and axial position of the reinforcing bar joint sleeve can be strictly ensured.

(b) Since all of the members used are solid members, a click feeling of, for example, abutment of the slide pins against the reinforcing bar joint sleeve is clear and hence it is easy to effect the work concerned.

(c) Since no elastic member is utilized as in the conventional device, the device according to the present invention is re-employable without damage to any components thereof.

The invention claimed is:

1. A reinforcing bar joint sleeve fixing device; comprising, a cylindrical ring member disposed in the interior of the reinforcing bar joint sleeve, a plurality of slide pins fitted in an outer wall of the ring member so as to be slidable radially outwards, an elastic ring for pressing the plural slide pins radially inwards, a shaft formed of a head portion and a rod portion, the head portion being received in the interior of the ring member and having a conical shape which increases in diameter in the direction of the reinforcing bar joint sleeve, an insertion hole formed in a molding form for inserting the rod portion of the shaft, a fixing member adapted to come into threaded engagement with a screw portion formed on the rod portion of the shaft, and slide portions formed at radial ends of the slide pins so as to be movable radially outwards in conformity with a tapered surface of the conical head portion of the shaft.

2. A reinforcing bar joint sleeve fixing device according to claim 1, wherein the slide portions formed at the radial ends of the slide pins are tapered surfaces conforming to the tapered surface of the head portion of the shaft.

3. A reinforcing bar joint sleeve fixing device according to claim 1, wherein the conical head portion of the shaft has a taper angle of 15 to 45 degrees.

4. A reinforcing bar joint sleeve fixing device according to claim 2, wherein the conical head portion of the shaft has a taper angle of 15 to 45 degrees.

* * * * *